United States Patent [19]

Roche

[11] 4,232,402

[45] Nov. 11, 1980

[54] MULTI-FUNCTIONAL CONVERTIBLE GARMENT

[76] Inventor: Elizabeth M. Roche, Post and Rail Farms Rd., Palos Park, Ill. 60464

[21] Appl. No.: 948,161

[22] Filed: Oct. 3, 1978

[51] Int. Cl.[2] ..... A41D 1/00

[52] U.S. Cl. ..... 2/93

[58] Field of Search ..... 2/93, 88, 70, 85, 269

[56] References Cited

U.S. PATENT DOCUMENTS

| | | | |
|---|---|---|---|
| 2,598,759 | 6/1952 | Calde | 2/70 |
| 2,622,247 | 12/1952 | Strauch | 2/70 |
| 3,018,485 | 1/1962 | Schulder | 2/70 |

OTHER PUBLICATIONS

Blum's–Vogue, Chicago Tribune, 9–13–1978, Sec. 2,P1.

*Primary Examiner*—Doris L. Troutman

*Attorney, Agent, or Firm*—Hill, Van Santen, Steadman, Chiara & Simpson

[57] ABSTRACT

A multi-functional convertible human garment adapted for furs and the like comprised of four pieces: a jacket member, a first extension member, a second extension member, and a belt member. The members utilize zipper-type slide fastener means permitting certain members which are locatable adjacent one another in various combinations to be interengaged with one another in various assemblies. Thus, the garment of the present invention can serve as a jacket, a stole, a street length or car coat, and a maxi or full length coat.

8 Claims, 6 Drawing Figures

MULTI-FUNCTIONAL CONVERTIBLE GARMENT

BACKGROUND OF THE INVENTION

Particularly in the case of furs, it would be desirable to have the capacity of employing the same basic garment for a variety of in-use applications, particularly in the field of outer clothing worn for evening or winter use. Since, so far as known to me, available garments are not convertible to different use situations, it is necessary to have at the present time a single garment for each class of use. For examples, a jacket cannot be used as a maxi or full length coat, and a stole cannot be used as a street length or car coat. If a single garment construction could be employed for a variety of different use situations, not only would clothing costs for a wardrobe be reduced, but also fewer items of clothing could be employed for a greater number of end use applications. In addition, since contemporary styles display a tendency to change relatively rapidly, an item of apparel, such as a coat, which could be converted to a different style rapidly, would be a very practical addition to a wardrobe since it would avoid early obsolesence.

BRIEF SUMMARY OF THE INVENTION

More particularly, the present invention provides a multi-functional convertible human garment which is particularly well adapted for furs and the like. The garment comprises a sleeve equipped jacket member, a first extension member circumferentially joinable to the jacket member, if desired, a second extension member circumferentially joinable to the first extension member, if desired, and a belt member circumferentially joinable, if desired, to either the lower circumferential portion of the first extension member or to the upper circumferential portion of the second extension member, if desired. Alternatively, such belt member may also serve in its own right as a waist girdling belt member if desired. Various combinations of such jacket member, such first extension member, such second extension member, and such belt member with one another, as more fully hereinafter explained, can be used to provide a jacket, a stole, a maxi or full length coat, or a street length or car coat.

Thus, by the present invention, a plurality of garment components are assemblable into various types of wearing apparel members. Such garment components can thus be used to provide clothing of different styles and shapes avoiding thereby problems of style change and permitting the user to have a single garment system for use in a variety of end-use applications. Particularly in the case of furs, which are expensive, the need for a multiplicity of separate fur garments may thus be avoided. The invention, however, is well adapted for use generally with coats, whether of a fabric or fur exterior, as desired.

Other and further aims objects, purposes, advantages, uses, and the like for the present invention will be apparent to those skilled in the art from the present specification.

DETAILED DESCRIPTION

Figure 1:
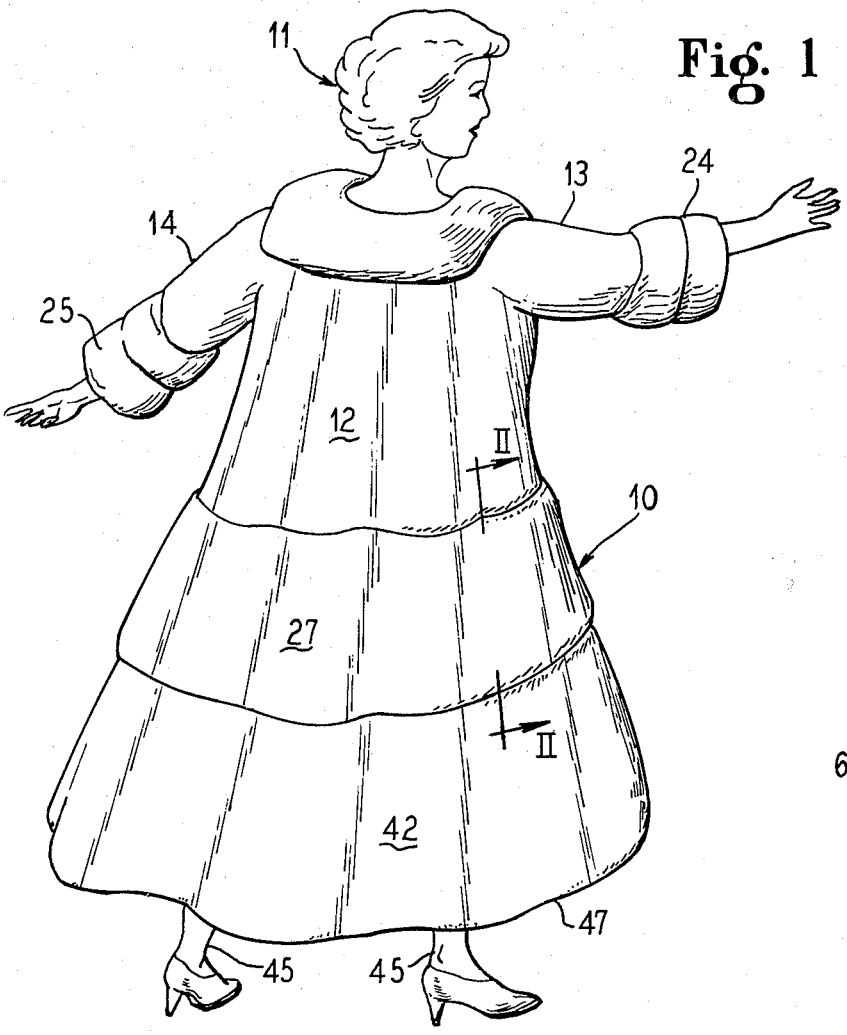
FIG. 1 is a back elevational view of one assembled configuration for one garment embodiment of the present invention shown being worn by a model.

Referring to FIG. 1, there is seen one assembled configuration for a multi-functional convertible human garment of this invention, the assembled configuration shown being that for a maxi or full length coat 10 being worn by a model 11. The full length coat 10 incorporates a jacket 12 equipped with sleeves 13 and 14. The jacket member 12 overlies upper portions of the model's torso 20 and is provided with vertically extending front opening mating flaps 16 and 17 (not shown in FIG. 1 but see FIG. 4). Jacket member 12 as here shown is a fur piece having an external fur portion 18 and an internal lining 19 functionally associated therewith by stitching (not detailed but conventional). The fur can be natural or synthetic, as desired.

Depending downwardly from a lower region of lining 19 circumferentially about the bottom edge portion 15 of jacket member 12 is one side of a zipper-type slide fastener member 21 which is mounted to lining 19 by means of stitches 22, or the like, as desired. Preferably, and as shown, the lower portion of slide fastener 21 generally terminates approximately equally with the lower circumferential edge portions of the jacket 12.

If desired, the jacket member 12 can have its flaps 16 and 17 equipped with a closure means (not detailed), such as a combination of button and button holes, clips, hook and eyes, zippers, or the like, as desired, as those skilled in the will readily appreciate.

The jacket member 12 is here provided with a collar 23, and the sleeves 13 and 14 are provided with cuffs 24 and 25, respectively; however, those skilled in the art will appreciate that any particular design for a jacket member 12 may be employed in the practice of the present invention, whether or not the same includes collar and sleeve portions, provided only that the jacket member involved incorporates a zipper-type slide fastener means as above described. Conventional zipper-type slife fasteners are usable in the practice of this invention.

The full length coat 10 incorporates a first extension member 27 overlying lower portions of the torso 20. The first extension member 27 is preferably configured in the nature of a relatively broad band having an exterior of fur 28 which is interiorly lined with a lining 29 conventionally secured thereto by stitching or the like (not detailed). The fur is preferably adapted to match the external fur portion 18 of jacket member 12 to achieve a desired aesthetic effect.

Upper circumferential portions 38 of first extension member 27 are adapted to be in a circumferentially spaced, preferably parallel relationship to bottom circumferential portions 39 of jacket member 12. The first extension member 27 is provided with vertically extending front opening mating flap portions 31 and 32 which are adapted to be aligned with, and to appear as extensions of, the corresponding respective flaps 16 and 17 of jacket member 12. If desired, the first extension member 27 may have its flap portions 31 and 32 provided with closure means (not detailed) which can be similar to the closure means optionally employed for a jacket member 12.

Figure 2:
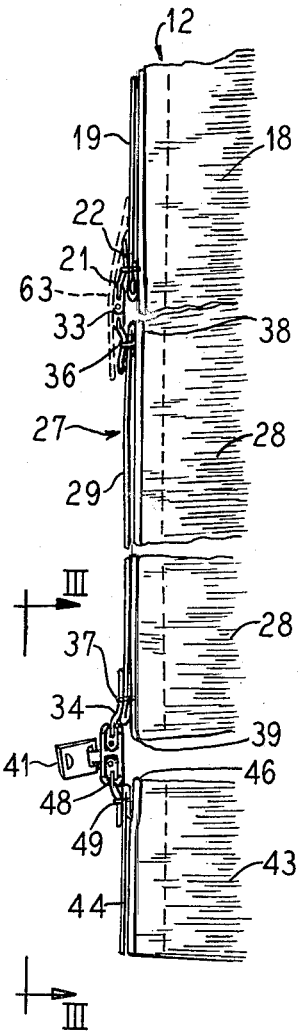
FIG. 2 is a fragmentary, vertical enlarged sectional view taken along the line II—II of FIG. 1 showing constructional details of the garment embodiment.
Figure 3:
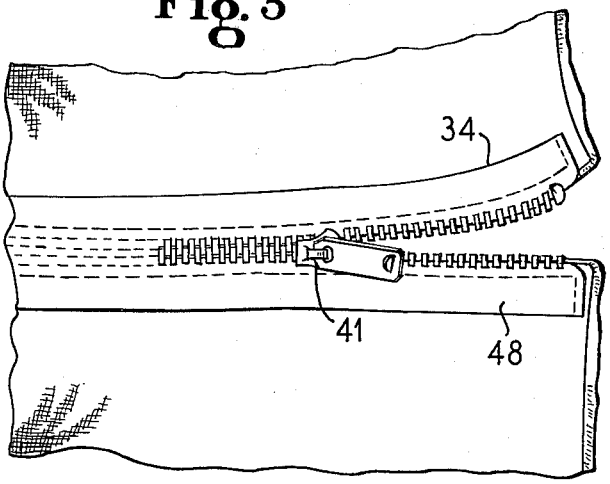
FIG. 3 is a fragmentary enlarged side elevational view taken along the line III—III of FIG. 2 showing further details of the garment embodiment.

Respective upper and lower circumferential edge portions of the first extension member 27 are each provided with one side of a zipper-type slide fastener member 33 and 34, respectively (see FIG. 2, for example). Such zipper-type slide fasteners 33 and 34 are mounted to the adjoining edge portions of lining 29 by means of stitches 36 and 37, respectively, or the like as desired. Analogously to the interrelationship between slide fastener 21 and jacket member 12, the respective slide fasteners 33 and 34 are preferably located so as to be adjacent and generally aligned with the respective upper and lower circumferential edge portions 38 and 39 of the first extension member 27.

In the embodiment shown, the lower circumferential edge portion 15 of the jacket member 12 is flared, and the lower circumferential edge portion 39 of first extension member 27 is flared relative to the upper circumferential edge portion 38. However, the upper circumferential edge portion 38 has substantially the same length as the lower circumferential edge portion 15. The respective zipper-type slide fasteners 21 and 33 are adapted to matingly engage conventionally with one another at one end thereof (not detailed), so that a slide, such as slide 41, can interengage the respective slide fasteners 21 and 33 together upon the achievement of which the lower circumferential edge portion 15 is joined to the upper circumferential edge portion 38 and jacket member 12 is joined to first extension member 27.

The full length coat 10 further includes a second extension member 42 which, like first extension member 27 in the embodiment shown has an outer face comprised of fur 43 and an interface comprised of a lining 44 with the lining 44 being secured to the fur 43 conventionally (not detailed). The fur is matched to the fur in order components of the garment so as to achieve a desired aesthetic effect. Also, like first extension member 27, the second extension member 42 is preferably in the nature of a relatively broad band which is circumferentially extendable in the nature of a loop about legs 45 depending from the torso 20 with vertically extending front opening mating flap portions (not detailed) which are generally alignable with the flaps 31 and 32 of the first extension member 27 so as to appear in an assembled coat 10 as continuations or extensions thereof. These flaps of the second extension member 42 can, likewise, if desired, be provided with flap portion closure means (not detailed) similar to those means employed or employable with the jacket member 12, as above described, if desired.

The upper circumferential edge portion 46 of second extension member 42 has a length which is approximately equal to that of the lower circumferential edge portion 39 of first extension member 27, but the lower circumferential edge portion 47 of second extension member 42 is flared relative to upper circumferential edge portion 46, in the embodiment shown. The upper circumferential edge portion 46 is provided with one side of a zipper-type slide fastener member 48 which is secured to adjacent portions of lining 44 by means of stitches 49 or the like. The slide fastener 48 is adapted to be alignable with and engagable with the slide fastener 34 so that adjacent ends thereof can be joined together (not detailed), and further so that the slide 41 can be moved therealong between the respective slide fasteners 48 and 34 so as to interengage the same together and thereby achieve a joining of the first extension member 27 to the second extension member 42 along the adjacent circumferential edge portions 46 and 39, respectively, when desired.

Although the full length coat 10 is downwardly and outwardly preferably flared from a position above the lower circumferential edge portion 15 of jacket member 12, one can, if desired, construct the jacket member 12, the first extension member 27, and the second extension member 42 so that substantially no or only a very slight flare is utilized in the coat 10 in which event the coat 10 then has a draped shaped, as will be appreciated.

When the second extension member 42 is disengaged from the first extension member 27 by disassociating the slide fastener 49 from the slide fastener 34 using the slide 41, there results a street length or car coat 51 (see FIG. 4) comprised of jacket member 12 and first extension member 27.

Figure 6:
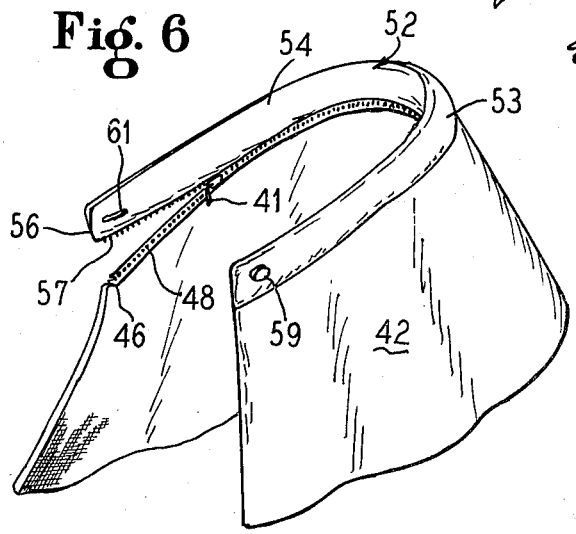
FIG. 6 shows still another embodiment of an assembled garment configuration of the present invention.

The second extension member 42 is associatable with a separate and independent belt member 52. The belt member 52 may be wrapped about waist regions of the wearer for tightening the jacket member 12 about the wearer's torso. Thus, the belt member 52 has an outer surface comprised of fur 53 and an inner lining 54 which is secured to the fur 53 by stitching or the like (not detailed but conventional). Preferably, the fur 53 is matched to the fur in the second extension member 42 so as to achieve a desired aesthetic effect. One circumferential edge portion 56 of belt member 52 is provided with one side of a zipper-type slide fastener 57 which is conveniently secured to belt member 52 in a manner similar to that employed for the slide fasteners 21, 33, 34, and 48 (not detailed). The length of belt member 52, and likewise of the zipper-type slide fastener 57 is such as to be substantially equal to the upper circumferential edge portion 56 of second extension member 42 and of the zipper-type slide fastener 48, respectively. Thus, the slide fastener 57 is interconnectable with the slide fastener 48 by means of slide 41 (which is normally carried by the slide fastener 48). By interengaging the belt member 52 with the second extension member 42, the slide fastener 48 is shielded and covered, thereby permitting the second extension 42 to be draped around the shoulders of a model, such as model 11 (not detailed), and thereby provide a stole construction. For purposes of positioning and holding the stole construction about the shoulders of a wearer, the opposed end portions of belt member 52 are preferably, and as shown in FIG. 6, provided with a co-acting and interengagable button 59 and buttonhole 61. Any convenient type of fastening means, if desired, can be used for mounting and holding the stole construction 58 about the shoulders of a wearer, as those skilled in the art will appreciate, however.

Figure 4:
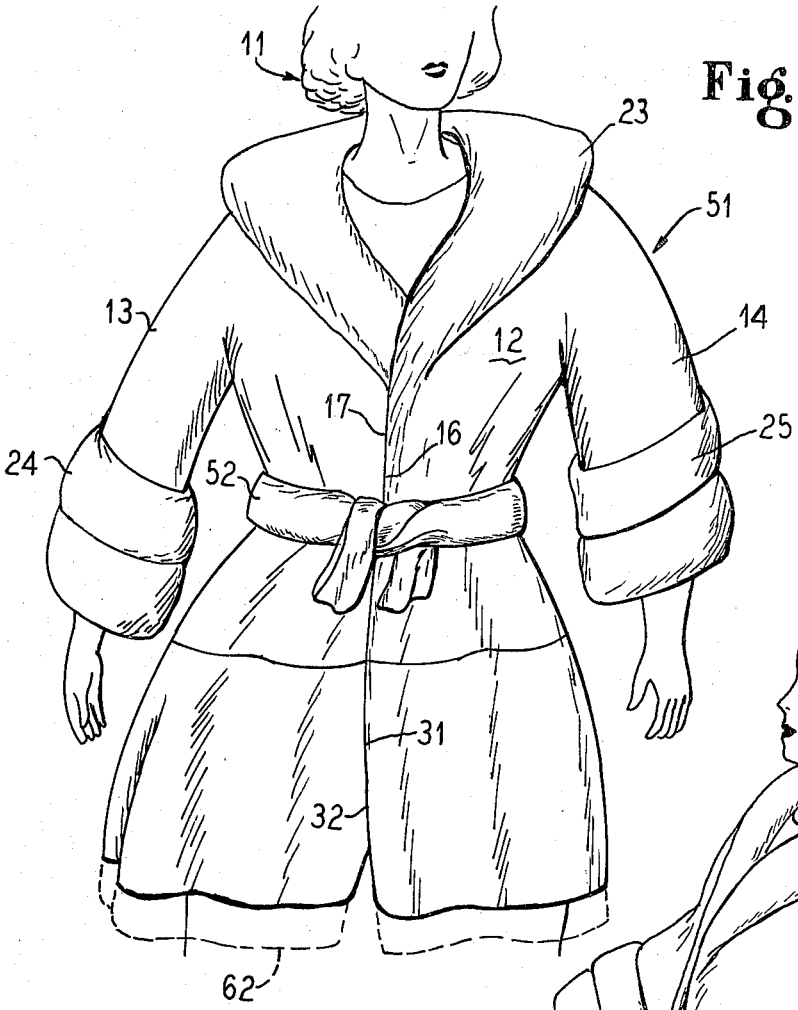
FIG. 4 is a front view of another assembled configuration for the garment embodiment of FIG. 1 being worn by a model.

With the belt member 52 disengaged from the second extension member 42, the belt member 52 can serve as a separately and independently mountable belt for use with the street length coat 51 in the manner shown, for example, in FIG. 4 wherein the belt ends 52 are simply overlapped upon one another in frictional engagement.

Alternatively, and preferably the belt member 52 may be engaged with the lower circumferential edge portion 39 of first extension member 27 through interengagement of the slide fastener 57 with the slide fastener 34 thus resulting in a positioning of the belt member 52 in a location as shown by the dotted lines 62 in FIG. 4 due care being taken to use zipper fastener members which permit such an engagement. An advantage of so engaging the belt member 52 with the first extension member 27 lies in the fact that such an engagement provides a finishing effect for the bottom edge of a street length coat 51, as those skilled in the art will appreciate.

Figure 5:
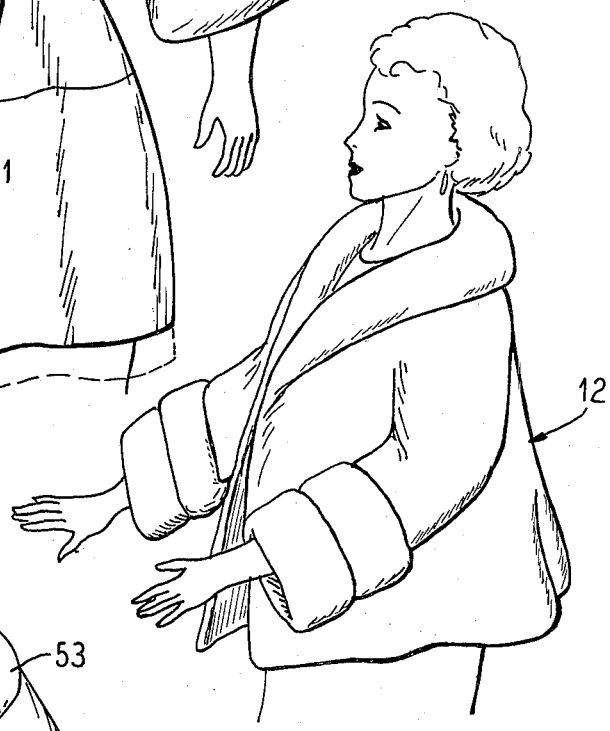
FIG. 5 is a side elevational view of another form of the garment embodiment shownin FIG. 1 shown as worn by a model.

When the first extension member 27 is disengaged from the jacket member 12 by the step of unfastening the associated slide fasteners 21 and 33, there results a separate jacket member 12 which can be separately worn in the manner illustrated, for example, in FIG. 5, if desired. The structural construction employed, as those skilled in the art will appreciate, may be such that when the jacket member 12 is separately worn, the belt member 52 may be optionally engaged with the lower circumferential edge portion 15 thereof (not here illustrated), as when it is desired to provide a finished construction for the lower circumferential edge portion of the jacket member 12.

Thus, it is seen that the plurality of garment components comprised of jacket member 12, first extension member 27, second extension member 42, and belt member 52 can be variously combined selectively with one another in different combinations to provide a plurality of garment constructions including a jacket, as shown in FIG. 5, a stole, as shown in FIG. 6, a maxi or full length coat, as shown in FIG. 1, and a street length or car coat, as shown in FIG. 4, for examples.

As a finishing aid, a garment embodiment of this invention may be optionally provided with zipper flaps, such as the zipper flap 63 shown in phantom lines which can be secured by stitching or the like (not detailed) to the lining 19 of jacket 12 so as to downwardly hang therefrom and extend over the area defined by interengaged slide fasteners 21 and 33.

In place of a fur exterior, a garment embodiment of this invention may have a cloth, a leather, or other exterior surfacing material, as desired whether natural or man-made in origin.

In preferred garment embodiments of this invention, the interrelationship between fasteners 21, 33, 34, 48, and 57 with their respective associated components, as explained above, in such that, as in the embodiment shown and described herein, the zipper fastener members do not show exteriorly when interconnected together as described so that a beholder cannot tell visually that a given garment configuration at hand is in fact comprised perhaps of more than one distinct member.

The zipper fasteners used in this invention are selected to that the desired combinations of garment components can be fastened together without problems of zipper fastener functionality. The zipper fasteners used characteristically employ slide members which are completely disengagable from one of the two zipper fastener side portions being interconnected together in any given instance. For reasons of maximizing wear of a garment construction of this invention, it is preferred to use lining constructions which are reinforced in the vicinity where the zipper fasteners are secured thereto.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth in the hereto-appended claims.

I claim:

1. A multi-functional convertible human garment comprising (A) a sleeve equipped jacket for overlying upper portions of a torso having
  (1) generally vertically extending, front opening, mating flaps, and
  (2) one side of a first zipper-type slide fastener member means depending about bottom circumferential portions of said jacket including means mounting said first fastener member to said jacket, (B) a first extension for overlying lower portions of such torso having
  (1) generally vertically extending, front opening, mating flaps,
  (2) upper circumferential portions thereof which are locatable in circumferentially adjacent relationship to said jacket bottom circumferential portions, said upper circumferential portions thereof being about equal to said jacket bottom circumferential portions, said first extension flaps being generally aligned with said jacket flaps,
  (3) bottom circumferential portions thereof in transversely spaced, generally parallel relationship to said upper circumferential portions thereof, and
  (4) one side of each of a second and a third zipper-type slide fastener member means depending about a different one of each of said upper circumferential portions thereof and said bottom circumferential portions thereof respectively, including respective means mounting said second and said third fastener members to said first extension, (C) a second extension for overlying upper leg portions depending from such torso or, alternatively, for overlying upper shoulder portions of such torso, said second extension having
  (1) generally vertically extending, front opening, mating flaps,
  (2) upper circumferential portions thereof which are locatable in circumferentially adjacent relationship to said first extension bottom circumferential portions, said upper circumferential portions thereof being about equal to said first extension bottom circumferential portions, said second extension flaps being generally aligned with said first extension flaps, and
  (3) one side of a fourth zipper-type slide fastener member means depending about said upper circumferential portions thereof including means mounting said fourth fastener member to said second extension, (D) a separate and independent belt means for tightening about waist regions of such torso, or alternatively, for extending over shoulder portions of such torso, said belt means having
  (1) upper and lower circumferential portions, said lower circumferential portions being locatable in circumferentially adjacent relationship to said second extension upper circumferential portions, said belt means being about equal in length to the distance about said second extension upper circumferential portions and being generally coextensible therewith, and (2) a single zipper means being one side of a fifth zipper-type slide fastener member means depending about said lower circumferential portions thereof, including means mounting said fifth fastener member to said belt means, (E) said first fastener member being disengagably interconnectable with said second fastener member, including reversable connecting means therefor, for engaging said jacket to said first extension, if desired, (F) said third fastener member being disengagably interconnectable with said fourth fastener member, including reversable connecting means therefor, for engaging said first extension to said second extension, if desired, (G) said fifth fastener member being disengagably interconnectable with said fourth fastener member for engaging said belt means with said second extension, if desired.

2. The garment of claim 1 wherein each of said jacket, said first extension, said second extension, and said belt means has a fur exterior and a lining means interiorly.

3. The garment of claim 1 wherein each of said jacket, said first extension, said second extension, and said belt means has a cloth exterior.

4. The garment of claim 1 wherein each of said jacket, said first extension said second extension, and said belt means has a leather exterior.

5. The garment of claim 1 wherein said belt means and its respective opposed end portions is provided with disengagable engaging means.

6. The garment of claim 3 wherein said disengagable engaging means comprises a coacting button mounted on one such end portion and a button hole formed in the opposed such end portion.

7. The garment of claim 1 wherein the interrelationship between said respective slide fastener members and their associated component portions is such that said slide fastener members do not show exteriorly when said fastener members are so interconnected with one another.

8. The garment of claim 1 wherein said fifth fastener member is disengagably interconnectable with said third fastener member, including reversable connecting means therefor, for engaging said belt means with said first extension, if desired.

* * * * *